United States Patent [19]

Hanson

[11] 4,406,564

[45] Sep. 27, 1983

[54] BREAKWATER

[76] Inventor: Raymond A. Hanson, P.O. Box 7400, Spokane, Wash. 99207

[21] Appl. No.: 289,136

[22] Filed: Aug. 3, 1981

[51] Int. Cl.[3] ..... E02B 3/06; B63B 35/34

[52] U.S. Cl. ..... 405/26; 14/27; 114/267

[58] Field of Search ..... 405/26, 27, 63, 219; 14/2.6, 27, 73; 114/258, 263, 264, 266, 267

[56] References Cited

U.S. PATENT DOCUMENTS

| | | | |
|---|---|---|---|
| 2,394,764 | 2/1946 | Greulich | 14/27 X |
| 3,222,871 | 12/1965 | Miller et al. | 405/27 |
| 3,426,537 | 2/1969 | Chenoweth et al. | 405/27 |
| 3,465,528 | 9/1969 | Usab | 405/27 |
| 4,318,361 | 3/1982 | Sluys | 114/263 |

FOREIGN PATENT DOCUMENTS

| | | | |
|---|---|---|---|
| 829763 | 5/1981 | U.S.S.R. | 405/26 |

*Primary Examiner*—David H. Corbin

*Attorney, Agent, or Firm*—Wells, St. John & Roberts

[57] ABSTRACT

A transportable submerged breakwater is described. The breakwater includes a pair of vertical parallel concrete walls spaced apart from each other. The walls have floatation cells containing buoyant means. The walls have a density slightly less than that of sea water and float in a substantially submerged condition with a top horizontal wall edge at or slightly above the water surface. Rigid members space the walls and rigging means provide tension to hold the walls against the rigid members.

12 Claims, 5 Drawing Figures

FIG 4
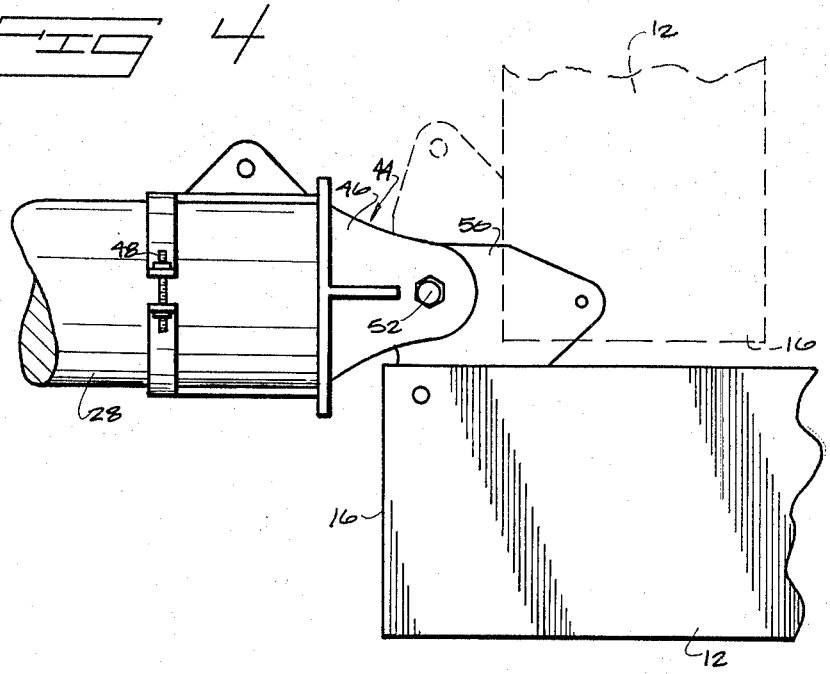
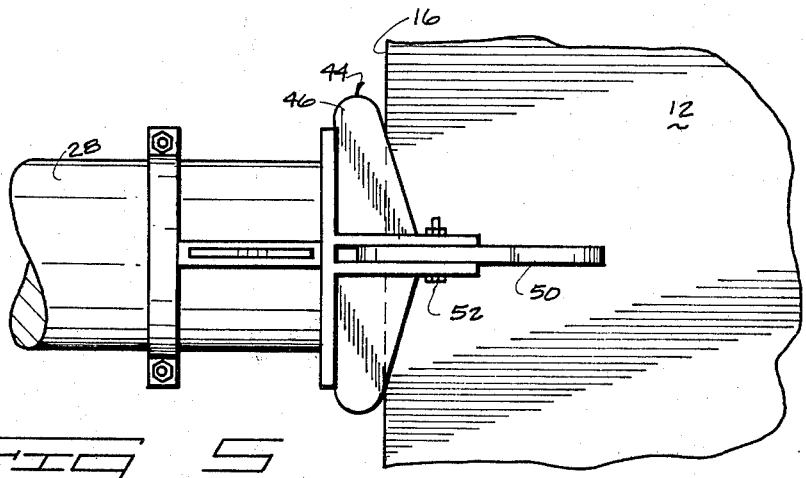
FIG 5

BREAKWATER

TECHNICAL FIELD

The present invention relates to breakwaters.

BACKGROUND OF THE INVENTION

A calm seaspace is often required for activities in or about the sea. Examples of places where such activities occur include fisheries, harbors, beaches, oil rigs, and others. Since weather and sea conditions do not always oblige these sea related activities, both floating and stationary breakwaters have been devised to calm the sea's tempestuous nature.

Typical of floating breakwater arrangements for calming the sea are the Matsudaira U.S. Pat. No. 3,969,901, the Magill U.S. Pat. No. 2,658,350, and the Chenoweth U.S. Pat. No. 3,426,537.

Matsudaira shows a central float with front and rear barriers joined by connecting members. The main feature of the Matsudaira invention is the central float. Due to this configuration, the barrier walls cannot be formed of a strong material, nor can they be formed in a size sufficient to give the breakwater a significant depth beneath the waves. Matsudaira also requires a complicated anchoring system to maintain breakwater inertia against wave movement.

Magill shows a mounting structure with a series of upstanding laterally spaced baffle members carried by the mounting structure. The baffles are disposed in a substantially parallel relation with an adjacent portion of the shoreline and have a height substantially equal to that of the maximum waves that occur outward to the unit. The baffles are positioned in the mounting structure so that the medial portions thereof are disposed at substantially the normal level of the body of water. Thus, the Magill breakwater extends substantially above the water line and it is exposed to pounding by waves and other sea stresses. As a result, the arrangement of fittings would soon work loose, necessitating frequent repair and maintenance. Apart from the excessive wear on such a design and the concomitant need for frequent repair, the wave action is not effectively abated. For effective wave control, the breakwater should extend substantially below the surface of the water rather than half below and half above the surface. Furthermore, the flimsy baffle arrangement provides very little breakwater inertia against wave motion. Rather, the Magill breakwater would tend to bob like a cork.

Chenoweth shows a raft. Aside from the time-consuming carpentry required to build the raft, it is questionable that much wave breaking effect could be achieved by the raft. Waves of significant size would tend to wash completely over the raft or bob the raft up like a float without much abatement in wave action. Due to the constant battering of the sea, such a raft would require frequent repairs; it would also be difficult and time-consuming to assemble and disassemble the raft for transportation.

Similar to the Chenoweth raft is the Gonzalez invention, U.S. Pat. No. 3,779,192. Gonzalez shows a concrete slab under which a floating material has been placed and which floating material is secured to the slab by a wooden underframe. Gonzalez and Chenoweth both show rafts with a horizontal orientation. Wave action is substantially a vertical phenomenon; the most effective wave control is accomplished by a unit having a similar orientation.

Floating breakwaters are not often permanent fixtures to the seaspace they control, so they should be readily transportable. Breakwaters are often used in out of the way places so they should be easily assembled at the site of use, preferably with locally obtainable materials. The prior art shows breakwaters that are either difficult to assemble and disassemble, that require skilled labor which is not often available near the site of installation, that require specially manufactured components, and that are not particularly effective as wave control devices. Some of the prior art breakwaters have all these disadvantages, all of them have some.

DISCLOSURE OF INVENTION

My invention relates to a transportable buoyant breakwater. The breakwater comprises a pair of vertical, parallel prestressed concrete walls. The walls are spaced transversely apart from one another and have a top horizontal edge and a bottom horizontal edge.

There are horizontal longitudinal floatation cells formed within each wall. Buoyant means are placed within each cell to provide the walls with a composite density slightly less than that of sea water. In this manner, the walls float in a substantially submerged condition with the top horizontal edge at or slightly above the water surface.

Connected between the walls and adjacent to their top horizontal edges are upper transverse elongated rigid members. Lower transverse elongated rigid members are operatively connected between the walls adjacent to their bottom horizontal edges. The walls are held securely against the upper and lower elongated members by a rigging means under tension that are operatively connected between the pairs of walls.

It is an object of my invention to provide an effective, improved breakwater capable of maximum wave control and requiring minimal expense to transport, assemble, and use.

BRIEF DESCRIPTION OF THE DRAWINGS

A preferred embodiment of my invention is illustrated in the accompanying drawings, in which:

FIG. 4 is a side view of a pivot plate; and

FIG. 5 is a plan view of the pivot plate.

BEST MODE FOR CARRYING OUT THE INVENTION

My invention is a transportable buoyant breakwater. The breakwater may be used in any area where a calm sea space is required. Examples of such areas include fisheries, harbors, beaches, etc.

Figure 1:
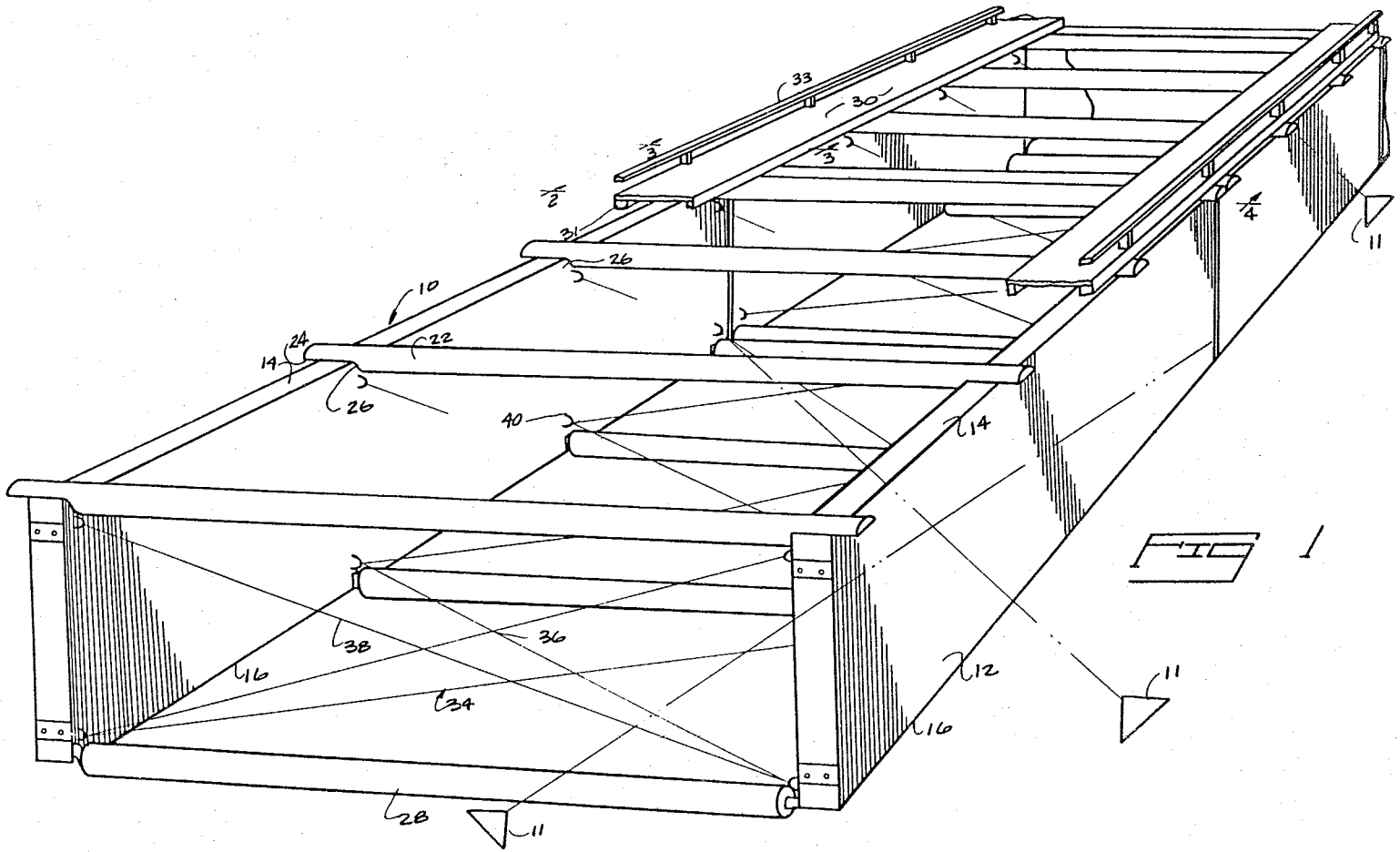
FIG. 1 is a perspective view of my invention.
Figure 1:
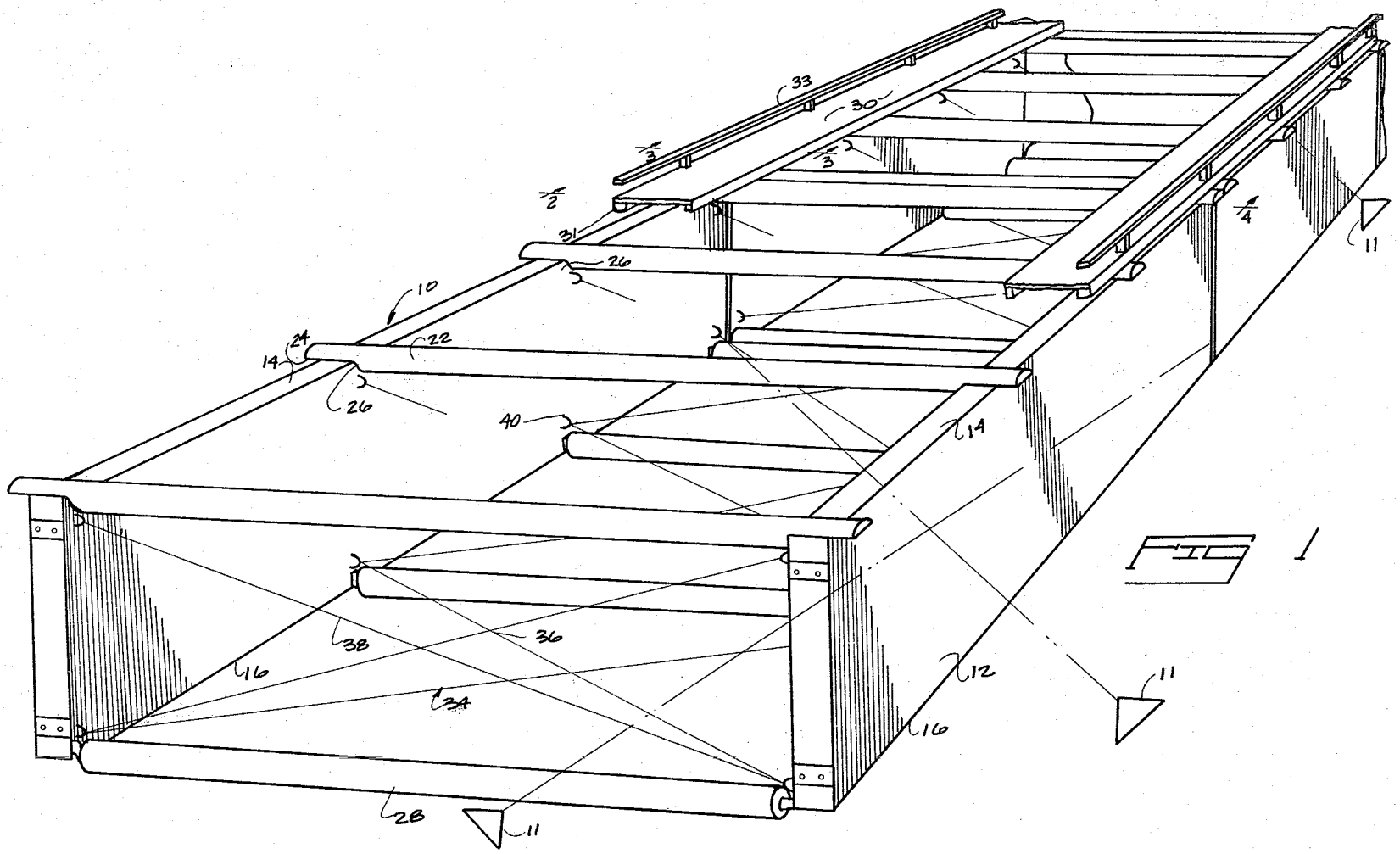

The breakwater 10 (FIG. 1) is comprised of a pair of vertical, parallel walls 12. The walls 12 are spaced transversely apart from one another. The breakwater walls 12 have a top horizontal edge 14 and a bottom horizontal edge 16.

Figure 2:
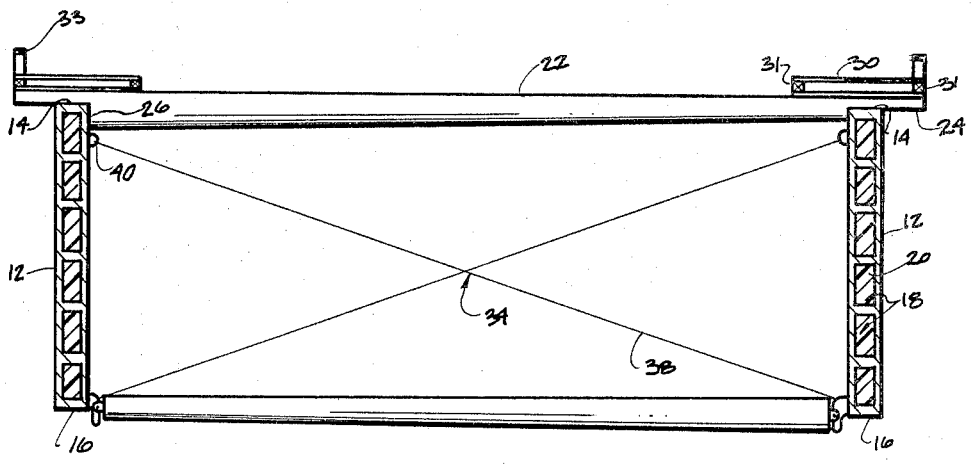
FIG. 2 is a sectional view of my invention along line 2—2.

The walls 12 are formed from prestressed concrete in an I-beam structure. (FIG. 2). The walls 12 contain horizontal longitudinal floatation cells 18. Within the floatation cells 18 are a buoyant means 20, such as a waterproof foamed resin (for example, Styrofoam).

The walls 12 are separated by upper transverse elongated rigid members 22. The members 22 are connected between the walls 12 and are adjacent to the top horizontal wall edges 14. The upper member 22 has a planar horizontal edge surface 24 that overlaps the wall top horizontal edge 14. The upper member 22 also has a planar vertical edge surface 26 adjacent to the wall 12 at the top horizontal wall edge 14. The two planar edges 24 and 26 form a notch at each end of the upper member 22.

Lower transverse elongated rigid members 28 are operatively connected between the walls 12. The lower members 28 are adjacent to the walls bottom horizontal edges 16.

Figure 3:
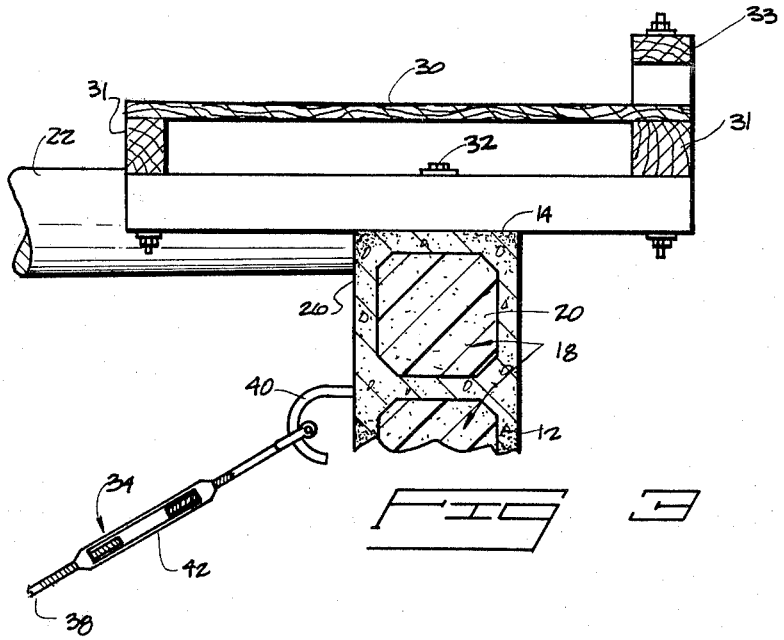
FIG. 3 is another sectional view of my invention along line 3—3.

A horizontal deck 30 (FIG. 3) is arranged along the length of the top horizontal wall edge 14. The deck 30 is stiffened by a deck support structure 31. The deck 30 is secured to the wall 12 by a deck bolt means 32. A deck rail 33 is also provided.

Rigging means 34 operatively connected between the pairs of walls 12 provide tension to hold the walls 12 securely against the upper and lower members 22 and 28.

The rigging means includes horizontal X-brace tension cables 36 operatively connected between the pairs of walls 12. The horizontal X-brace cables 36 repeat at equal intervals throughout the length of the breakwater walls. Vertical X-brace tension cables 38 are also operatively connected between the pairs of walls 12. The vertical X-brace cables 38 also repeat at equal intervals along the length of the breakwater walls 12. The cables 36 and 38 are fastened to the walls 12 at tension points along the walls by cables fastening means 40. An adjusting turnbuckle 42 (FIG. 3) is provided to adjust cable tension.

The cable tension pulls the wall sections 12 together. The cable tension exerted on the walls causes the walls 12 to compress the top and bottom elongated members 22 and 28. The results is a rigid, strong breakwater configuration.

The breakwater is economical and easy to assemble. The walls 12 are made of prestressed concrete and may be poured on the beach near the site where the breakwater is to be positioned. Standard prestressing techniques involving cables, ferrules, and slipform pouring of concrete are used to form the walls. The buoyant means 20 within the wall floatation cells 18 may be poured and foamed in place while the walls are being formed.

Once the walls are formed, they are floated out to sea to the installation site in wall sections. A pivot plate means 44 (FIGS. 4 and 5) adjacent to the bottom horizontal wall edges 16 provides a pivotal interconnection point between the wall sections 12 and the lower transverse elongated rigid members 28. A first pivot plate section 46 is connected to the lower members 28 with a bolting means 48. A second pivot plate section 50 is attached to the wall 12 adjacent to the bottom horizontal edge 16. The second pivot plate section 50 is usually placed within the wall 12 when the concrete is being poured. In this way, a very secure fastening point is formed. The two pivot plate sections 46 and 50 mate. They are held together at the pivot point by a pivot pin 52.

The breakwater is formed when two wall sections are floated to the breakwater site and the walls are operably interconnected with the lower transverse elongated rigid members 28. Once the walls 12 and the bottom members 28 are operably interconnected by the pivot plate means 44 the wall top horizontal edges 14 are pulled together. The walls 12 are brought to a parallel, vertical position by the action of cables (not shown) across the top horizontal wall edge 14 that are tightened by a winch means (not shown). The lower members 28 keep the walls 12 spread while the walls are brought to the vertical, parallel orientation. The weight of the walls causes the breakwater 10 to gradually sink as the walls 12 become more near parallel. Initial wall position is indicated in FIG. 4 by a solid line; final wall position (vertical and parallel) is indicated in FIG. 4 by a dashed line.

When the walls are parallel, the upper transverse elongated rigid members 22 are connected between the walls 12. The upper members 22 have spaced outer ends comprising horizontal and vertical planar surfaces 24 and 26 that overlap and abut the top horizontal wall edges 14.

The horizontal and vertical cables 36 and 38 that form the rigging means 34, are laced between the cable fasteners 40. The cable tension is adjusted with an adjusting turnbuckle 42 (or other such adjusting means). When the cable is properly adjusted the breakwater is rigid and able to withstand the extreme stress of wave motion.

An anchor means 11 is operatively connected to the breakwater (usually at a wall) to prevent the breakwater from drifting out of its affixed location. The anchor may be of any standard design and its shape is not critical to the correct operation of the breakwater.

After the breakwater is in position and assembled, the horizontal deck 30 may be installed along the length of the walls top horizontal edge 14. The deck supports 31 are first installed to the wall 12 by deck bolt means 32. The deck 30 is then attached to the deck supports 31. Although a deck is provided, it is not necessary for effective operation of the breakwater. Rather, the deck is provided as a convenience for inspection, docking and recreational purposes.

In operation, the assembled breakwater has a density slightly less than that of sea water. The breakwater floats in a substantially submerged condition with the top horizontal wall edge 14 at or slightly above the water surface. The relatively large volume of the walls and the floatation cells 18 within them provide increased floatation for the heavy concrete from which the breakwater walls are formed.

Wave action extends below the water surface. To provide most effective wave control, the breakwater must extend down at least 10 feet. Most prior breakwaters did not extend more than 6 feet beneath the surface. The present invention extends down beneath the surface 10 feet for maximum wave control and wave energy dissipation.

By being substantially submerged the breakwater does not provide a surface against which waves may peak and break. Consequently, the breakwater performs its function without substantial stress during rough seas. In this way, the breakwater, although much sturdier than previous breakwaters, is much less prone to be damaged. Furthermore, having the entire surface of the breakwater walls at or below the wave peaks (the water surface) provides maximum wave smoothing affect. That is, the entire wall surface is available for wave smoothing rather than a portion which extends below wave level. The waste of having wall sections above the water surface is thus avoided.

The breakwater has great mass due to its concrete construction. In addition to providing increased strength and durability, the mass of the breakwater provides substantial inertia against wave motion. The result is a more stable breakwater (important if the breakwater doubles as a dock) with significantly enhanced wave damping characteristics. The present breakwater is modular and can be configured in serial chains of ganged breakwaters for any desired length of wave protection. The breakwater may also be linked in other patterns. Because each breakwater section formed may be linked to another, large areas of sea may be brought under control.

Of further significance in this invention, are the breakwaters economies. That is, its transportability, its ease of assembly, and the inexpensive materials used to construct it.

Transportation costs are not a significant factor because most materials required to form the breakwater can be acquired locally and delivered to a beach near the site for assembly. Delivery and transportation charges are not a significant factor because most of the materials are locally available.

Assembly of the breakwater is simple (described above). No specialized worker skills are required to assembly the breakwater, nor is any special construction equipment required. The breakwater is quickly assembled at the site. The walls can be formed at a beach near the site and floated to the site for final assembly, and most labor requirements can be filled locally.

The materials required to construct the breakwater are relatively inexpensive. That is, concrete, cable, and material to form the elongated members (which can be logs or metal poles of standard lengths and shapes) are standard, lower-priced items.

It is to be understood that the foregoing discussion related to an embodiment of my invention but not to limitations thereon. Only the following claims are to be taken as a definition of my invention.

I claim:

1. A transportable buoyant breakwater, comprising:
a pair of vertical, parallel prestressed concrete walls spaced transversely apart from one another;
said walls having a top horizontal edge and a bottom horizontal edge;
horizontal longitudinal floatation cells formed within each wall;
buoyant means within each cell for providing the walls with a density slightly less than that of sea water wherein said walls float in a substantially submerged condition with the top horizontal edge at or slightly above the water surface;
upper transverse elongated rigid members connected between the walls adjacent to their top horizontal edges;
lower transverse elongated rigid members operatively connected between the walls and adjacent to their bottom horizontal edges;
rigging means operatively connected between the pairs of walls for providing tension to hold the walls securely against the upper and lower elongated members.

2. A breakwater as defined in claim 1 wherein the buoyant means comprises a waterproof foamed resin.

3. A breakwater as defined in claim 1 wherein the upper transverse elongated rigid members have spaced outer ends respectively abutting the top horizontal edges of the walls.

4. A breakwater as defined in claim 3 further comprising:
pivot plates operatively connected between the lower transverse elongated rigid members and adjacent the bottom horizontal edges of the walls wherein the walls and the lower rigid members are pivotally interconnected about a horizontal axis.

5. A breakwater as defined in claim 4 wherein the rigging means comprises:
horizontal X-brace tension cables operatively connected between the pairs of walls;
vertical X-brace tension cables operatively connected between the pairs of walls;
fastening means at tension points along the walls for operatively connecting the horizontal and vertical X-brace tension cables to the walls and for providing tension to hold the walls securely against the upper and lower elongated members.

6. A transportable buoyant breakwater comprising:
a pair of vertical, parallel prestressed concrete walls spaced transversely apart from one another;
said walls having a top horizontal edge and a bottom horizontal edge;
horizontal longitudinal floatation cells formed within each wall;
buoyant means within each cell for providing the walls with a density slightly less than that of seawater wherein said walls float in a substantially submerged condition with the top horizontal edge at or slightly above the water surface;
upper transverse elongated rigid members connected between the walls and abutting the top horizontal edges;
lower transverse elongated rigid members operatively connected between the walls and adjacent the bottom horizontal edges;
rigging means operatively connected between the pairs of walls for providing tension to hold the walls securely against the upper and lower elongated members;
a horizontal deck arranged along the length of the top horizontal edge of the walls.

7. A breakwater as defined in claim 6 wherein the buoyant means comprises a waterproof foamed resin.

8. A breakwater as defined in claim 7 further comprising:
pivot plates operatively connected between the lower transverse elongated rigid members and adjacent the bottom horizontal edges of the walls wherein the walls and the lower rigid members are pivotally interconnected about a horizontal axis.

9. A breakwater as defined in claim 8 wherein the rigging means comprises:
horizontal X-brace tension cables operatively connected between the pairs of walls;
vertical X-brace tension cables operatively connected between the pairs of walls;
fastening means at tension points along the walls for operatively connecting the horizontal and vertical X-brace tension cables to the walls and for providing tension to hold the walls securely against the upper and lower elongated members.

10. A breakwater as defined in claim 9 wherein the walls have an I-beam structure.

11. A breakwater as defined in claim 10 wherein the upper transverse elongated rigid members further comprise:
planar horizontal edges overlapping the top horizontal edges of the walls; and
planar vertical edges adjacent the walls at the top horizontal edges of the walls.

12. A breakwater as defined in claim 11 wherein the breakwaters are modular and may be serially ganged.

* * * * *